US008591286B2

(12) United States Patent
Chen et al.

(10) Patent No.: US 8,591,286 B2
(45) Date of Patent: Nov. 26, 2013

(54) APPARATUS AND METHOD FOR TEMPERATURE CONTROL DURING POLISHING

(75) Inventors: Hung Chih Chen, Sunnyvale, CA (US); Samuel Chu-Chiang Hsu, Palo Alto, CA (US); Gautam Shashank Dandavate, Sunnyvale, CA (US); Denis M. Koosau, Hayward, CA (US)

(73) Assignee: Applied Materials, Inc., Santa Clara, CA (US)

( * ) Notice: Subject to any disclaimer, the term of this patent is extended or adjusted under 35 U.S.C. 154(b) by 502 days.

(21) Appl. No.: 12/854,432

(22) Filed: Aug. 11, 2010

(65) Prior Publication Data

US 2012/0040592 A1 Feb. 16, 2012

(51) Int. Cl.
*B24B 49/00* (2012.01)

(52) U.S. Cl.
USPC ..... 451/7; 451/41; 451/285; 451/286; 451/287

(58) Field of Classification Search
USPC ..... 451/7, 41, 285–290
See application file for complete search history.

(56) References Cited

U.S. PATENT DOCUMENTS

| | | | | |
|---|---|---|---|---|
| 4,270,361 | A | 6/1981 | La Barge | |
| 6,077,151 | A * | 6/2000 | Black et al. | 451/53 |
| 6,749,484 | B2 * | 6/2004 | Yang et al. | 451/7 |
| 7,153,188 | B1 | 12/2006 | Zuniga et al. | |
| 7,210,991 | B1 | 5/2007 | Van Der Veen et al. | |
| 7,335,088 | B1 * | 2/2008 | Hwang et al. | 451/7 |
| 2003/0114077 | A1 * | 6/2003 | Yang et al. | 451/7 |
| 2007/0082589 | A1 | 4/2007 | Zuniga et al. | |
| 2007/0272356 | A1 | 11/2007 | Chen et al. | |
| 2008/0119122 | A1 | 5/2008 | Zuniga et al. | |
| 2009/0242125 | A1 | 10/2009 | Paik et al. | |
| 2010/0035515 | A1 | 2/2010 | Marks et al. | |

FOREIGN PATENT DOCUMENTS

| | | |
|---|---|---|
| JP | 09-057611 | 3/1997 |
| KR | 10-2002-0020717 | 3/2002 |

OTHER PUBLICATIONS

International Search Report and Written Opinion Dated Feb. 12, 2012 for International Application No. PCT/US2011/040630.

* cited by examiner

*Primary Examiner* — Maurina Rachuba
(74) *Attorney, Agent, or Firm* — Patterson & Sheridan, LLP

(57) ABSTRACT

Embodiments of the present invention relate to apparatus and method for improve uniformity of a polishing process. Embodiments of the present invention provide a heating mechanism configured to apply thermal energy to a perimeter of a substrate during polishing, or a cooling mechanism configured to cool a central region of the substrate during polishing, or a biased heating mechanism configured to create a temperature step differential on a given radius of a polishing pad.

20 Claims, 6 Drawing Sheets

APPARATUS AND METHOD FOR TEMPERATURE CONTROL DURING POLISHING

BACKGROUND OF THE INVENTION

1. Field of the Invention

Embodiments of the present invention generally relate to an apparatus and a method for polishing semiconductor substrates. More particularly, embodiments of the present invention provide apparatus and method for temperature control when polishing semiconductor substrates to improve uniformity.

2. Description of the Related Art

During fabrication of a semiconductor device, various layers, such as oxides, and copper, require planarization to remove steps or undulations prior to formation of subsequent layers. Planarization is typically performed mechanically, chemically, and/or electrically using processes such as chemical mechanical polishing (CMP), and electro-chemical mechanical polishing (ECMP).

Chemical mechanical polishing typically includes mechanically abrading a substrate in a slurry that contains a chemically reactive agent. During chemical mechanical polishing, the slurry is delivered on a polishing pad and the substrate is typically pressed against the polishing pad by a carrier head. The carrier head may also rotate and move the substrate relative to the polishing pad. As a result of the motion between the carrier head and the polishing pads and chemicals included in the slurry, the non-planar substrate surface is planarized by chemical mechanical polishing.

However, various factors of CMP process can lead to non-uniformity causing non-planar artifacts on the substrate surface. For example, during processing, different regions on the substrate may have different speeds relative to the polishing pad and different accessibility to the slurry resulting in temperature variation within different regions of the substrate. Substrate surface temperature is one of the factors that affect removal rate. Consequently, temperature variations within the substrate may lead to non-uniformity, such as non-planar surface, within the substrate.

For example, FIG. 1 illustrates a prior art polishing result with non-uniformity. Plot 10 in FIG. 1 is a profile of a substrate after polishing. The x-axis indicates a distance from a center of the substrate and the y-axis indicates the thickness of the substrate. As shown by the curve 11, there are pumps 12, 13 near the edge of the substrate.

Therefore, there is a need for apparatus and method for improving uniformity in polishing.

SUMMARY OF THE INVENTION

The present invention generally relates to a method and apparatus for polishing semiconductor substrates. Particularly, embodiments of the present invention provide apparatus and method for improving polishing uniformity.

One embodiment provides a substrate carrier head comprising a base plate and a flexible membrane coupled to the base plate. An outer surface of the flexible membrane provides, a substrate-receiving surface, and an inner surface of the flexible membrane and the base plate define a plurality of chambers to provide independently adjustable pressures to a corresponding plurality of regions of the substrate-receiving surface. The substrate carrier head further comprises an edge heater disposed in a first chamber of the plurality of chambers corresponding to a perimeter region of the substrate-receiving surface.

Another embodiment provides an apparatus for polishing a substrate comprising a platen rotatable about a central axis, a polishing pad disposed on the platen, and a substrate carrier head configured to hold a substrate and to press the substrate against the polishing pad during processing. The substrate carrier head comprises a base plate and a flexible membrane coupled to the base plate. An outer surface of the flexible membrane provides a substrate-receiving surface, and an inner surface of the flexible membrane and the base plate define a plurality of chambers to provide independently adjustable pressures to a corresponding plurality of regions of the substrate-receiving surface. The substrate carrier head further comprises an edge heater disposed in a first chamber of the plurality of chambers corresponding to a perimeter region of the substrate-receiving surface.

Yet another embodiment provides a method for processing a substrate, comprising mounting a substrate on a substrate carrier head, rotating a polishing pad, and polishing the substrate using the substrate carrier head and the polishing pad. Polishing the substrate comprises moving the substrate relative to the rotating polishing pad while pressing the substrate against the polishing pad using the substrate carrier head, heating an edge region of the substrate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Embodiments of the present invention generally relate to an apparatus and a method for polishing a semiconductor substrate. Particularly, embodiments of the present invention relates to an apparatus and method for improving uniformity.

Embodiments of the present invention provide a heating mechanism configured to apply thermal energy to a perimeter of a substrate during polishing, or a cooling mechanism configured to cool a central region of the substrate during polishing, or a biased heating mechanism configured to create a temperature step differential on a given radius of a polishing pad.

One embodiment of the present invention provides a substrate carrier head having a heater disposed near an edge region of the substrate carrier head and a cooling mechanism disposed near a center region of the substrate carrier head. In another embodiment, the substrate carrier head comprises a retaining ring coupled to a retaining ring heater. Another embodiment of the present invention comprises a spot heater configured to heat a region of a polishing pad. Embodiments of the present invention comprise heating or cooling a portion of the substrate being polished to improve polishing uniformity.

Embodiments of cleaning modules may be adapted to benefit from the invention is a REFLEXION®, a REFLEXION LK® and a REFLEXION GT® polisher, available from Applied Materials, Inc., located in Santa Clara, Calif.

Benefits of the present invention include reducing non-uniform removal rates across a substrate caused by center hot-edge cold temperature profile during polishing. Embodiment of the present invention may also be used to address S-shaped non-uniform removal profile caused by pressure differentials between different zones of a membrane that presses against the substrate during polishing.

Embodiments of the present invention may be used in chemical mechanical polishing of metal, such as copper, and chemical mechanical polishing dielectric layers, such as pre-metal dielectric layers.

Figure 1:
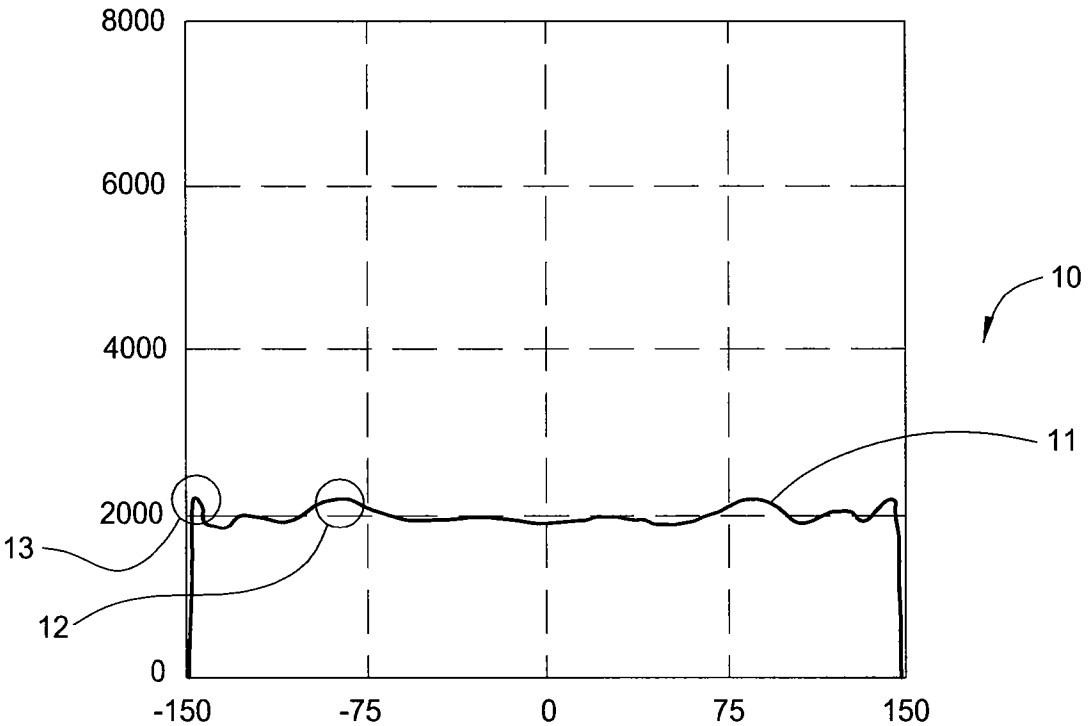
FIG. 1 ( PRIOR ART )
FIG. 1 is a plot showing a prior art polishing result with non-uniformity.
Figure 2:
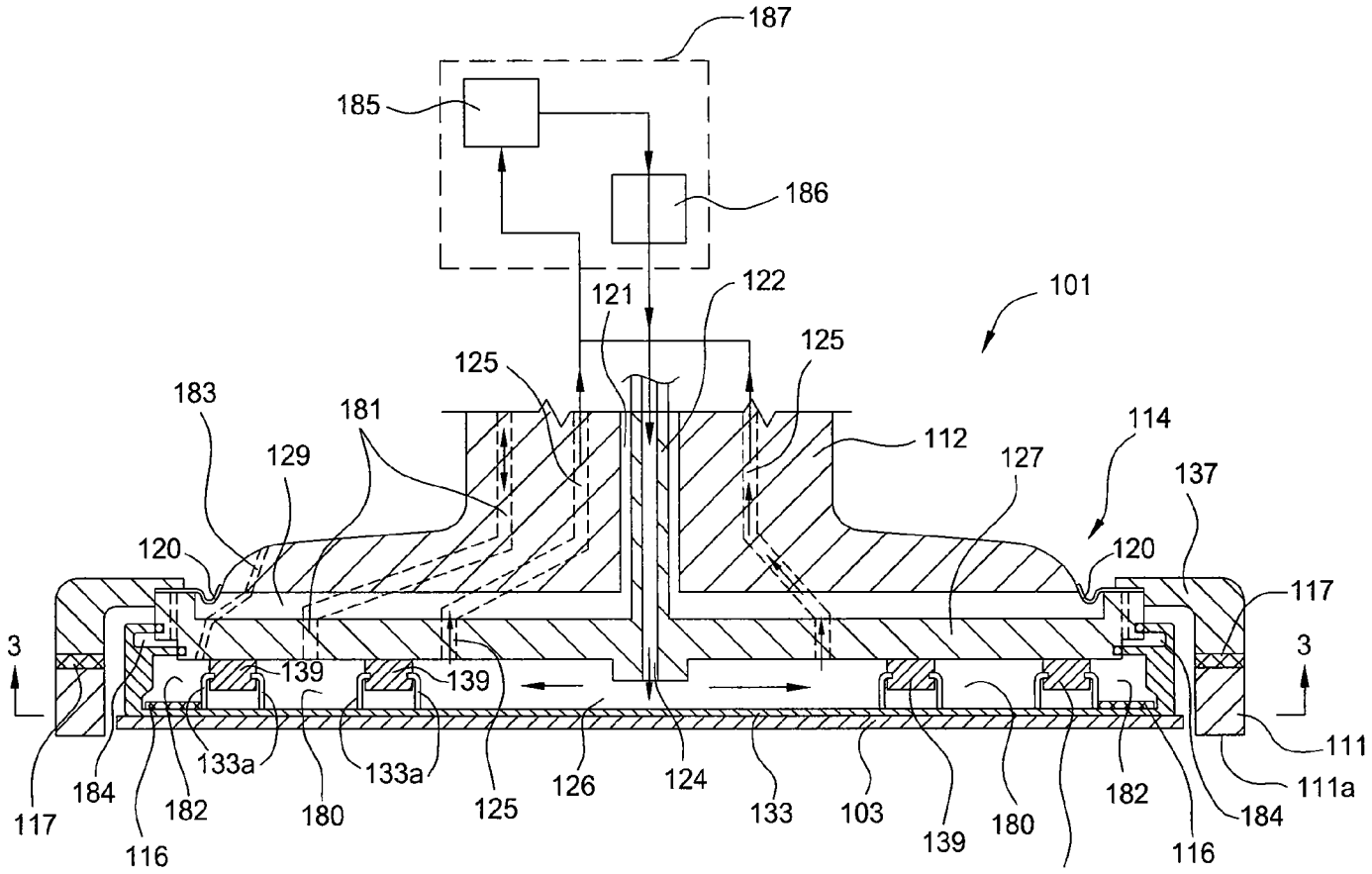
FIG. 2 is a schematic sectional side view of a substrate carrier head in accordance with one embodiment of the present invention.

FIG. 2 is a schematic sectional side view of a substrate carrier head 101 in accordance with one embodiment of the present invention. The substrate carrier head 101 is generally configured to transfer a substrate 103 and to hold the substrate 103 against a polishing pad (not shown) during polishing. During polishing, the substrate carrier head 101 is configured to distribute a downward pressure across the back surface of the substrate 103.

The substrate carrier head 101 generally comprises a housing 112 movably coupled to a base assembly 114. A loading chamber 129 is formed between the housing 112 and the base assembly 114.

The housing 112 is generally circular in shape and can be connected to a drive shaft (not shown) to rotate and or sweep therewith during polishing. A vertical bore 121 may be formed through the housing 112 to allow relative motions of the base assembly 114. The base assembly 114 comprises a rigid base plate 127, a gimbal rod 122 extending from the rigid base plate 127 and loosely sliding vertically the vertical bore 121 of the housing 112. The base assembly 114 is a vertically movable assembly located beneath the housing 112.

A ring-shaped rolling diaphragm 120 flexibly connects the housing 112 to the rigid base plate 127 of the base assembly 114. The gimbal rod 122 and the ring-shaped rolling diaphragm 120 allow the housing 112 to transfer rotating motion to the base assembly 114 and allow the base assembly 114 to move vertically relative to the housing 112. The ring-shaped rolling diaphragm 120 bends to permit the base assembly 114 to pivot with respect to the housing 112 so that the substrate 103 can remain substantially parallel with the polishing surface of the polishing pad.

The loading chamber 129 is defined by the housing 112, the ring-shaped rolling diaphragm 120, and the rigid base plate 127. The loading chamber 129 is used to apply a load, i.e., a downward pressure or weight, to the base assembly 114. The vertical position of the base assembly 114 relative to a polishing pad is also controlled by the loading chamber 129.

The base assembly 114 further comprises a retaining ring 111. The retaining ring 111 may be a generally annular ring secured at the outer edge of the rigid base plate 127 via an adaptor 137. The retaining ring 111 is configured to prevent the substrate 103 from slipping away from the substrate carrier head 101 during polishing. A bottom surface 111*a* of the retaining ring 111 may be substantially flat, or it may have a plurality of channels to facilitate transport of polishing composition from outside the retaining ring 111 to the substrate.

A flexible membrane 133 is generally clamped on a bottom side of the rigid base plate 127 of the base assembly 114. In one embodiment, the flexible membrane 133 and the rigid base plate 127 may form multiple chambers, for example, chambers 126, 180, 182, 184. The chambers 126, 180, 182 apply pressure or generate vacuum between the flexible membrane 133 and a backside of the substrate 103 to engage the substrate 103. In one embodiment, the flexible membrane 133 comprises dividers 133*a* configured to sealably coupled to attachment points 139 extending from the rigid base plate 127 and form the multiple chambers 126, 180, 182.

The chambers 126, 180, 182, 184 are connected to fluid sources and can be inflated and deflated for securing the substrate 103, release the substrate 103, and apply pressure to the substrate 103. In one embodiment, a single channel may be connected to each chamber 126, 180, 182, 184 which can be inflated by flowing a fluid, such as gas or water, to the each chamber via the single channel and deflated by draining the fluid from each chamber via the single channel. As shown in FIG. 2, each of the chambers 126, 180, 182 is connected to fluid source via a channel 125, 181, 183 respectively.

Figure 3:
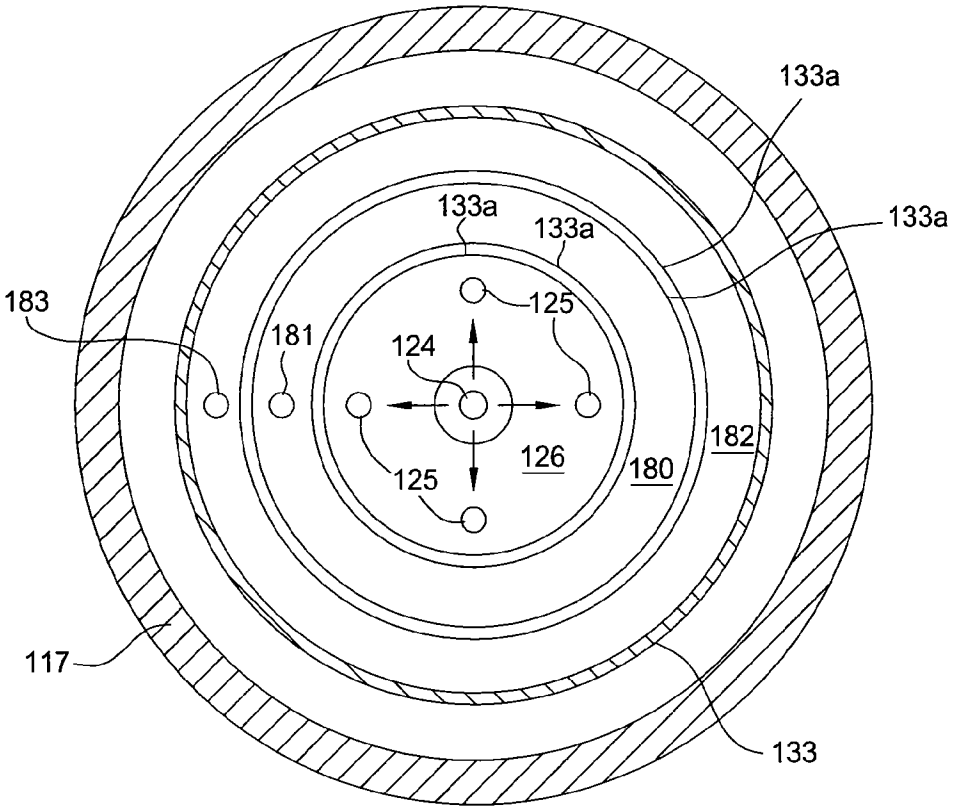
FIG. 3 is a schematic top view of the substrate carrier head of FIG. 2.

In one embodiment, the chambers 126, 180, 182, 184 (not shown in FIG. 3) are concentrically arranged as shown in FIG. 3. Even though four concentric chambers are described in the substrate carrier head 101, substrate carrier heads with less or more concentric chambers or with a plurality of chambers arranged in a non-concentric pattern are encompassed by embodiments of the present invention.

In one embodiment, one or more chamber 126, 180, 182 may have separate inlet and outlet fluid channels, for example one or more inlet channels for flowing a fluid into the chamber and one or more outlet channels for draining the fluid from the chamber. During processing, a constant flow of fluid is flown through the chamber to provide heat exchange and maintain the pressure needed in the chamber.

In one embodiment, the center chamber 126 is connected to a temperature and pressure control unit 187 via one inlet channel 124 and a plurality of outlet channels 125. The temperature and pressure control unit 187 comprises a fluid source 185 connected to a heat exchange device 186. The heat exchange device 186 may comprise a heater and a cooling device.

During polishing, a fluid, for example an inert gas, or water, is pumped from the fluid source 185 to the chamber 126 through the heat exchange device 186 wherein the fluid is heated or cooled to a desired temperature. The heated or cooled fluid in the chamber 126 acts as heat exchange fluid to maintain temperature for a portion of the substrate 103 corresponding to the chamber 126. The fluid flow to the chamber 126 also provides a pressure to the substrate required by the polishing process. The pressure may be varied by adjusting flow rate of the fluid towards the chamber 126.

In one embodiment, as shown in FIG. 3, the chamber 126 has one inlet channel 124 disposed near a center of the chamber 126 and a plurality of outlet channels 125 evenly distributed in an outer region of the chamber 126 to enable substantially even distribution of fluid flow from the center to the edge.

To inflate the chamber 126 and apply a pressure against the substrate 103, a flow of fluid, such as air, nitrogen gas, or water, is supplied to the chamber 126 through inlet channel 124. The flow of fluid travels from the inlet channel 124 radially outward to the plurality of the outlet channels 125, and exits the chamber 126. The pressure in the chamber 126 can be maintained or adjusted by maintaining or adjusting of the flow rate of the fluid. To deflate the chamber 126, the flow of fluid ceases from the inlet channel 124, and the chamber 126 can be drained from the plurality of outlet channel 125 actively using a vacuum pump, or passively without using a vacuum pump.

In one embodiment, the temperature and pressure control unit 187 is configured to provide cooling fluid to one or more chambers in a center region of the substrate carrier head 101, such as the chamber 126, to cool a center region of the substrate 103 during processing.

The substrate carrier head 101 further comprises an edge heater 116 disposed near an edge region of the flexible membrane 133 and configured to heat the edge region of the substrate during processing. In one embodiment, the edge heater 116 is a ring shaped film heater attached to an inner surface of the flexible membrane 133 in an outer chamber, such as chamber 182.

Figure 4:
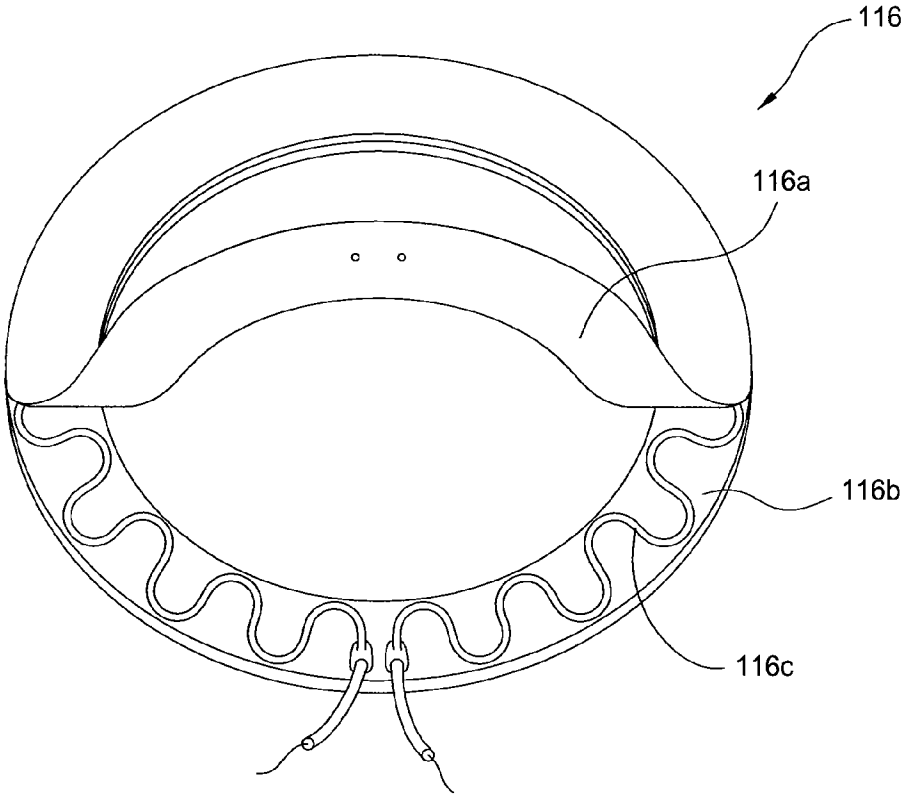
FIG. 4 is a perspective view of heater used in embodiments of the present invention.

The edge heater 116 may be any heater that is small enough to fit in the space and corrosion resistant. FIG. 4 illustrates one embodiment a perspective view of the edge heater 116. The edge heater 116 comprises an upper film 116*a*, a lower film 116*b* and a heating element 116*c* disposed between the upper film 116*a* and the lower film 116*b*. The heating element 116*c* may be etched foil or wire-bound element. The upper film 116*a* and the lower film 116*b* may be polyimide films that remain stable within a large range of temperature, such as KAPTON® film from DuPont.

Referring back to FIG. 2, the substrate carrier head 101 further comprises a retaining ring heater 117 configured to heat the retaining ring 111 during processing. In one embodiment, the retaining ring heater 117 may be a ring-shaped film heater, similar to the edge heater 116 of FIG. 4, disposed between the retaining ring 111 and the adapter 137. In another embodiment, the retaining ring heater 117 may be a heating element embedded in the retaining ring 111 or the adapter 137.

By providing cooling to the center chamber 126 and/or heating to the edge chamber 182 and the retaining ring 111, the substrate carrier head 101 can effectively compensate temperature differences between the center region and the edge region of the substrate and improve uniformity during polishing. The edge heater 116, retaining ring heater 117, and the cooling fluid in chamber 126 can be used separately or combined.

Embodiments of the present invention further comprises apparatus and method for spot heating a polishing pad to compensate temperature difference between center region and the edge region of the substrate during polishing.

Figure 5:
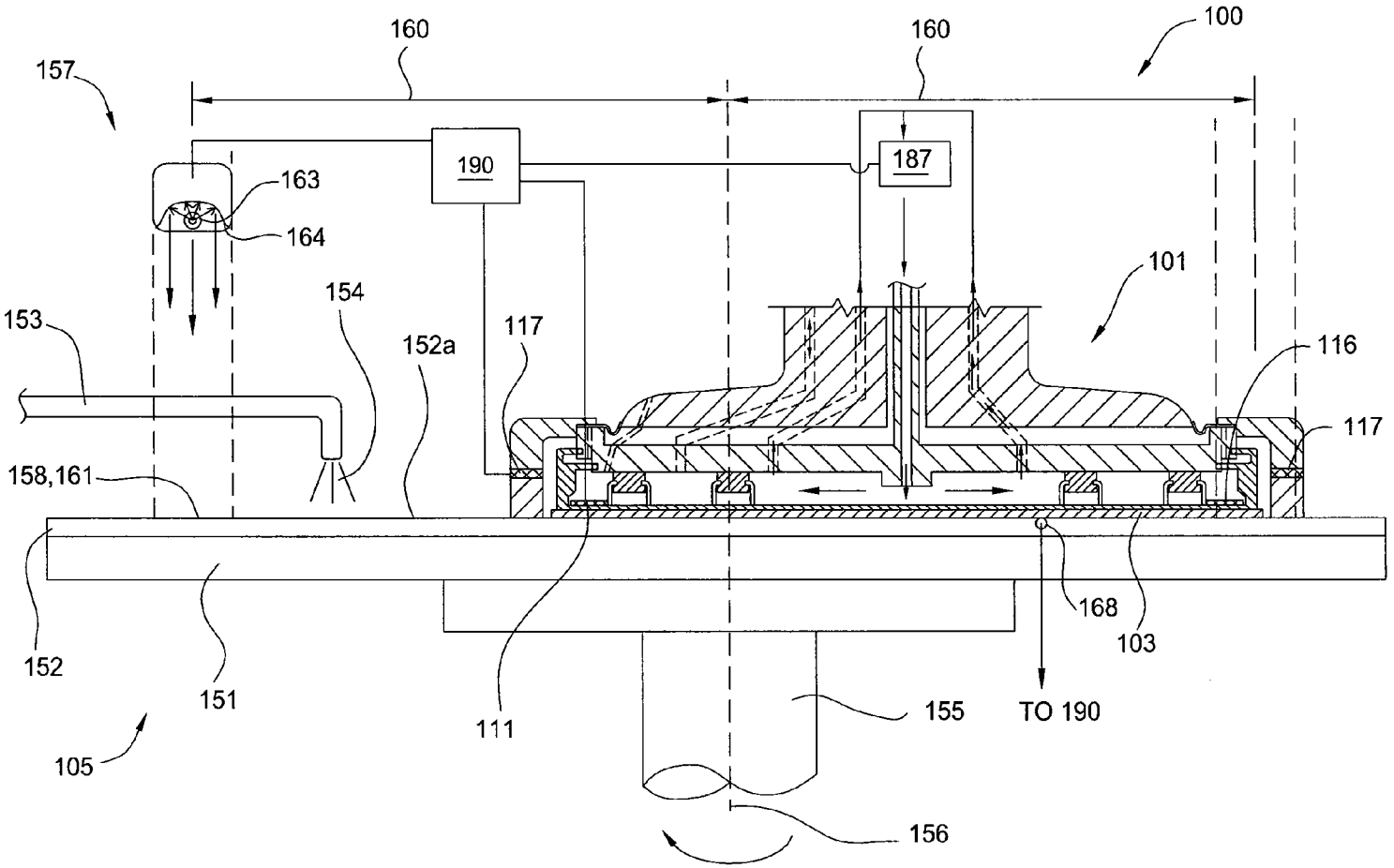
FIG. 5 is a sectional side view of a polishing station in accordance with one embodiment of the present invention.
Figure 6:
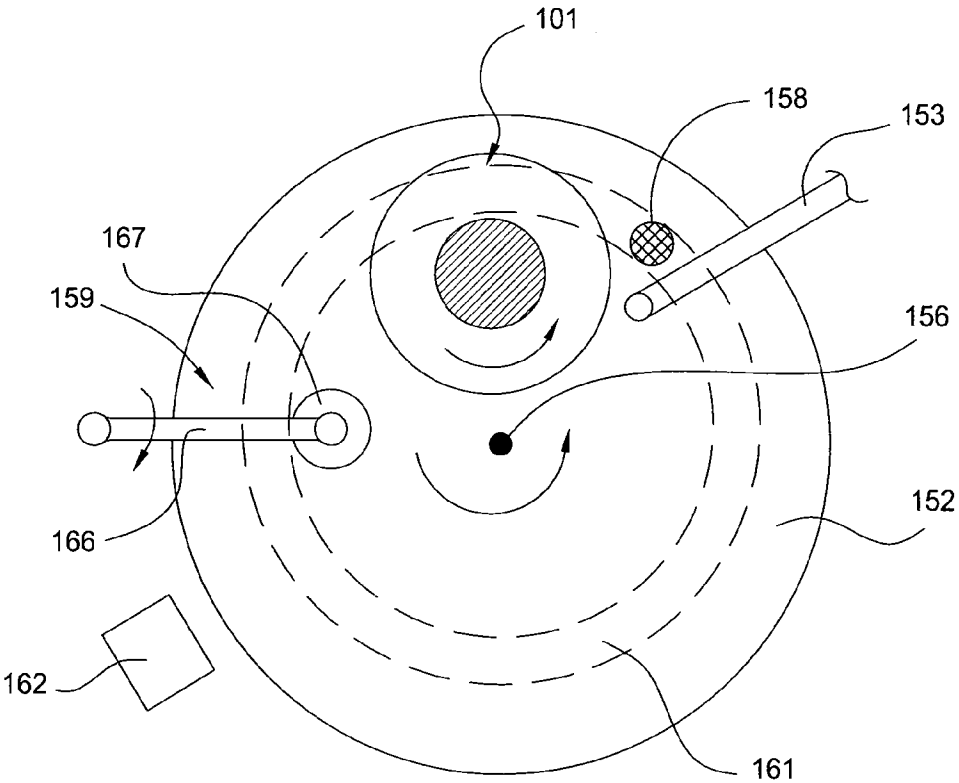
FIG. 6 is a plan view of the polishing station of FIG. 5.

FIG. 5 is a sectional side view of a polishing station 100 in accordance with an embodiment of the present invention. FIG. 6 is a plan view of the polishing station 100 of FIG. 5. The polishing station 100 generally comprises a rotatable platen 151 on which a polishing pad 152 is placed, and a substrate carrier head 101 movably disposed over the polishing pad 152. The polishing station 100 may be a stand-alone device having one substrate carrier head 101 and one platen 151. The polishing station 100 may also be disposed on a system having multiple platens and multiple carrier substrate heads circulate among the multiple platens.

The rotatable platen 151 and the polishing pad 152 are generally larger than a substrate 103 being processed to enable uniform processing and/or allow multiple substrates being processed at the same time. For example, if the substrate 103 is an eight inch (200 mm) diameter disk, the platen 151 and the polishing pad 152 are about 20 inches in diameter. If the substrate 103 is a twelve inch (300 mm) diameter disk, the platen 151 and the polishing pad 152 are about 30 inches in diameter. In one embodiment, the platen 151 is a rotatable aluminum or stainless steel plate connected by a stainless steel drive shaft 155 to a platen drive motor (not shown). For most polishing processes, the platen drive motor rotates the platen 151 about a central axis 156 at speed between about 30 to about 200 RPM (revolutions per minute), although lower or higher rotational speeds may be used.

The polishing pad 152 has a roughened polishing surface 152*a* configured to polish the substrate 103 using a chemical mechanical polishing (CMP) method or an electrical chemical mechanical polishing (ECMP) method. In one embodiment, the polishing pad 152 may be attached to the platen 151 by a pressure-sensitive adhesive layer. The polishing pad 152 is generally consumable and may be replaced. In one embodiment, the platen 151 may be replaced by a polishing structure having a belt pad made of CMP or ECMP materials.

The polishing station 100 further comprises a polishing composition supplying tube 153 configured to provide sufficient polishing solution (or slurry) 154 to cover and wet the entire polishing pad 152. The polishing solution 154 generally contains a reactive agent, e.g. deionized water for oxide polishing, abrasive particles, e.g., silicon dioxide for oxide polishing, and a chemical-reactive catalyzer, e.g., potassium hydroxide for oxide polishing.

The polishing station 100 may further comprise a pad conditioner 159 configured to maintain the condition of the polishing pad 152 so that it will effectively polish any substrate pressed against it. In an embodiment, the pad conditioner 159 may comprise a rotatable arm 166 holding an independently rotating conditioner head 167 and an associated washing basin 162.

The polishing station 100 further comprises a spot heater 157 configured to direct thermal energy towards a target spot 158 on the polishing pad 152. When the polishing pad 152 rotates about the central axis 156, the spot heater 157 can heat a band 161 of the polishing pad 152. In one embodiment, the band 161 overlaps with a region where the edge of the substrate 103 contacts the polishing pad 152 during polishing.

In one embodiment, the spot heater 157 may include a radiant energy source, such as a lamp 163, and a focusing reflector 164 configured to reflect and focus the radiant energy from the lamp 163 to the target spot 158. During processing, the edge region of the substrate 103 may contact the polishing pad 152 at a distance 160 away from the central axis 156. In one embodiment, the lamp 163 is disposed at the distance 160 away from the center axis 156 to cover the band 161. The spot heater 157 may be positioned anywhere above the band 161.

In one embodiment, the spot heater 157 is disposed above the polishing pad 152 to direct thermal energy to the target spot 158 immediately up-stream to the substrate carrier head 101, as shown in FIG. 6. This configuration allows the region of polishing pad 152 to rotate underneath the substrate carrier head 101 immediately after being heated by the spot heater 157. The efficiency of the spot heater 157 is improved by positioning the spot heater 157 immediately up-stream to the substrate carrier head 101 because the heated region has a short exposure to the environment and the polishing slurry.

In one embodiment, the spot heater 157 may be turned on with the polishing pad 152 rotating for a period before polishing to preheat the band 161, which contacts an edge region of the substrate 103 during polishing.

In an alternative embodiment, the spot heater 157 may also be a ring shaped thin film heater disposed under the polishing pad 152 for heating the band 161.

The polishing station 100 may further comprise a controller 190. The controller 190 may control and adjust the spot heater 157, the retaining ring heater 117, the edge heater 116, or the temperature and pressure control unit 187 to obtain uniformity during polishing.

In one embodiment, the controller 190 may be coupled to temperature sensors 168, such as thermal couples, used to measure temperatures of the substrate 103 at different radius, or temperature of the polishing pad 152 in contact with the substrate 103. The controller 190 may adjust the spot heater 157, the retaining ring heater 117, the edge heater 116, or the temperature and pressure control unit 187 according to temperature measurement from the temperature sensors. In one embodiment, the controller 190 may generate an in-situ thermal imaging of the substrate during processing and use the in-situ thermal imaging of the substrate to perform real time temperature control.

The controller 190 may also be set up to activate the spot heater 157, the retaining ring heater 117, the edge heater 116, or the temperature and pressure control unit 187 individually, simultaneously, or in various combination to achieve processing goals.

The temperature control mechanisms of the present invention, such as the spot heater 157, the retaining ring heater 117, the edge heater 116, and the temperature and pressure control unit 187, provides spatial temperature control within the substrate or the polishing pad. The temperature control mechanisms of the present invention can also perform transient temperature control the substrate, the substrate carrier head, and the polishing pad if activated prior to polishing, during polishing, and/or after polishing.

While the foregoing is directed to embodiments of the present invention, other and further embodiments of the invention may be devised without departing from the basic scope thereof, and the scope thereof is determined by the claims that follow.

What is claimed is:

1. A substrate carrier head, comprising:

a base plate;

a flexible membrane coupled to the base plate, wherein an outer surface of the flexible membrane provides a substrate-receiving surface, and an inner surface of the flexible membrane and the base plate define a plurality of chambers to provide independently adjustable pressures to a corresponding plurality of regions of the substrate-receiving surface; and an edge heater disposed in a first chamber of the plurality of chambers corresponding to a perimeter region of the substrate-receiving surface, wherein the plurality of chambers are concentrically arranged, and the first chamber has a ring shape and is located outer most among the plurality of chamber.

2. The substrate carrier head of claim 1, further comprising a cooling unit connected to a second chamber of the plurality of chambers corresponding to a central region of the substrate-receiving surface, wherein the second chamber has a circular shape and is located inner most among the plurality of the chambers.

3. The substrate carrier head of claim 2, wherein the edge heater is a ring shaped heater attached to the inner surface of the flexible membrane in the first chamber.

4. The substrate carrier head of claim 3, wherein the edge heater is a film heater comprising:

an upper film made of polyimide; and a lower film made of polyimide; and a heating element disposed between the upper film and the lower film.

5. The substrate carrier head of claim 3, wherein the heating element is an etched coil.

6. The substrate carrier head of claim 2, wherein the cooling unit is connected to the second chamber through an inlet opening located near a center of the second chamber and a plurality of outlet openings evenly distributed near an edge region of the second chamber.

7. The substrate carrier head of claim 6, wherein the cooling unit comprises:

a fluid source connected to the inlet opening of the second chamber for supplying a fluid flow to the second chamber; and a heat exchange unit configured to cool the fluid flow to a desired temperature.

8. The substrate carrier head of claim 6, wherein the cooling unit comprises a fluid source connected to the inlet opening of the second chamber, and the cooling unit inflates and deflates the second chamber by providing a flow of a heat exchanging fluid to the second chamber and ceasing the flow of the heat exchanging fluid respectively.

9. The substrate carrier head of claim 2, further comprising a heated retaining ring assembly disposed near an outer perimeter of the flexible membrane.

10. The substrate carrier head of claim 9, wherein the heated retaining ring assembly comprises:

a retaining ring attached to the base plate; and a ring-shaped film heater disposed between the retaining ring and the base plate.

11. An apparatus for polishing a substrate, comprising:

a platen rotatable about a central axis;

a polishing pad disposed on the platen; and a substrate carrier head configured to hold a substrate and to press the substrate against the polishing pad during processing, the substrate carrier head comprises:

a base plate;

a flexible membrane coupled to the base plate, wherein an outer surface of the flexible membrane provides a substrate-receiving surface, and an inner surface of the flexible membrane and the base plate define a plurality of chambers to provide independently adjustable pressures to a corresponding plurality of regions of the substrate-receiving surface; and an edge heater disposed in a first chamber of the plurality of chambers corresponding to a perimeter region of the substrate-receiving surface.

12. The apparatus of claim 11, wherein the substrate carrier head further comprises a cooling unit connected to in a second chamber of the plurality of chambers corresponding to a central region of the substrate-receiving surface.

13. The apparatus of claim 12, further comprising a spot heater configured to direct thermal energy to a target region on the polishing pad that contacts an edge region of the substrate during polishing, wherein the spot heater comprises a heating lamp disposed above the polishing pad.

14. The apparatus of claim 13, wherein the target region is located immediately upstream to the substrate carrier head.

15. The apparatus of claim 12, wherein the substrate carrier head further comprises a heated retaining ring assembly disposed near an outer perimeter of the flexible membrane.

16. The apparatus of claim 15, further comprising a controller connected with one or more sensors configured to measure temperature of the substrate and the polishing pad, wherein the controller adjusts the spot heater, the heated retaining ring assembly, the edge heater, and the cooling unit according to temperature measurements of the polishing pad and the substrate.

17. A method for processing a substrate, comprising:

mounting a substrate on a substrate carrier head;

rotating a polishing pad; and polishing the substrate using the substrate carrier head and the polishing pad, wherein polishing the substrate comprises:

moving the substrate relative to the rotating polishing pad while pressing the substrate against the polishing pad using the substrate carrier head; and heating an edge region of the substrate, wherein mounting the substrate comprises mounting the substrate on a flexible membrane having a plurality of chambers, and heating the edge region comprises activating a heater disposed in an outer chamber of the flexible membrane.

18. The method of claim 17, wherein polishing the substrate further comprises cooling a central region of the substrate, and cooling the central region of the substrate comprises providing a flow of a heat exchange fluid to a central chamber of the flexible membrane.

19. The method of claim 18, wherein heating the edge region of the substrate further comprises heating a retaining ring disposed radially outward of the flexible membrane.

20. The method of claim 17, further comprising heating a target region on the polishing pad, the target region is within a band that contacts the edge region of the substrate during polishing.

* * * * *